United States Patent [19]

Coppins et al.

[11] 4,449,652

[45] May 22, 1984

[54] PREFABRICATED BOW FORMING MACHINE

[76] Inventors: Timothy G. Coppins, 10737 Rose Ave., Ontario, Calif. 91761; Jerry B. Coppins, 4538 Bodega Ct., Montclair, Calif. 91763

[21] Appl. No.: 455,749

[22] Filed: Jan. 5, 1983

[51] Int. Cl.[3] ..... A41H 43/00

[52] U.S. Cl. ..... 223/46; 28/147

[58] Field of Search ..... 223/46; 28/147

[56] References Cited

U.S. PATENT DOCUMENTS

| | | | |
|---|---|---|---|
| 3,637,455 | 1/1972 | Pearson et al. | 223/46 X |
| 3,661,307 | 5/1972 | Jacobson | 223/46 |
| 3,790,041 | 2/1974 | Pearson et al. | 223/46 |

FOREIGN PATENT DOCUMENTS 22250 6/1972 Italy .

*Primary Examiner*—Louis Rimrodt
*Attorney, Agent, or Firm*—David O'Reilly

[57] ABSTRACT

A prefabricated bow forming machine in which a pair of ribbons are mated along their sides with a strap approximately centrally disposed lengthwise of said pair of ribbons. The pair of ribbons and strap are joined together at the head end and the ribbons are bonded together to form seams at preselected intervals along their length at either side of the strap. The seams are at an angle to the respective edges of the ribbons and are oppositely angled with adjacent seams. The bow forming machine has a bench on which the pair of ribbons are laid out in a track with the strap centrally disposed lengthwise therebetween. The machine includes a pivotable press which swings down against the bench and heat welds the pair of ribbons at preselected intervals to form the seams. The bench and press have heat elements which spot weld the two ribbons at preselected intervals and angles. The number of welded seams along the length of the ribbon determines the number of loops and size of the bow. With four welds equally spaced along the length of the ribbons, the bow will have eight equally spaced loops of the same size. A ornamental device is secured to the head end where the strap is secured to the ribbons to be neatly disposed in the center of the bow when the ribbons are drawn into the loops.

8 Claims, 9 Drawing Figures

PREFABRICATED BOW FORMING MACHINE

FIELD OF THE INVENTION

This invention relates to prefabricated bows and, more particularly, relates to a method and apparatus for forming such bows.

BACKGROUND OF THE INVENTION

The wholesale and retail florist industry is interested in presenting their products in attractively decorated packages. Plants and floral arrangements are often adorned with ribbons and bows and set into attractive outer shells lined with colorfully decorated paper. Thus, there is a need for a bow and ribbon which can be easily attached to a plant or floral arrangement. Unlike the packaging industry, the ribbon cannot be used to tie up the package with the bow attached by an adhesive. The bow must be attached without interfering with or damaging the floral arrangement or plant.

Since the wholesale and retail florist industry has expanded to a variety of stores such as supermarkets, local variety stores, etc., the need for attractive, easily attached bows has increased. Thus, it would be advantageous to be able to produce easily attached bows for the wholesale and retail florist industry in large quantities.

There already exists various machines and methods for manufacturing prefabricated bows. Some of these devices are in the form of machines having various mechanical arms and fingers which form loops, from which completed bows are then removed in a preformed condition. However, these methods of manufacturing bows are complicated, cumbersome and expensive and the bow produced are unsuitable for attachment to plants and floral arrangements.

To solve this problem, a bow forming machine has been designed having a pair of ribbons with a drawstring centrally disposed along the length of the ribbons with the ribbons secured by an adhesive at intervals on either side of the strap. The bonds are perpendicular to the edges of the ribbon so that a flat bow is formed similar in shape to the bow tie. To form a bow having many random loops, notches are made in the edges of the ribbons at selected intervals. The disadvantage of this device is that the bows are either a flat plurality of straight loops, such as the bow tie shape, or have a plurality of bunched loops forming an aesthetically unappealing pom pom shape. The machine for manufacturing these prefabricated bows is also generally complicated. Further, the bows formed by this method are directed toward the packaging industry and are not suitable for attachment to plants or floral arrangements.

It is therefore one object of the present invention to provide a prefabricated bow in which the bow is automatically formed into a plurality of spaced, equal sized loops, suitable for attachment to plants and floral arrangements.

Another object of the present invention is to provide a prefabricated bow comprised of a pair of ribbons having bonded seams at angles to the edges of the pair of ribbons.

Another object of the present invention is to provide a bow forming machine in the form of a bench and press which provides heat welds to bond the ribbons at a plurality of preselected intervals and angles.

Yet another object of the present invention is to provide a bow forming machine having means to supply ribbon, cut the ribbon and provide bonded seams at preselected intervals by heat melting spots in a line at predetermined angles and intervals along the pair of ribbons.

Still another object of the present invention is to provide a prefabricated bow including means for easily attaching the bow to a plant or floral arrangement.

BRIEF DESCRIPTION OF THE INVENTION

A prefabricated bow is formed of a pair of ribbons with their sides mated having a strap centrally disposed along the length of the ribbon. The ribbons and strap are fastened together at a head end. At preselected intervals along the length spaced for the head end, the ribbons are bonded on either side of the strap. Preferably the bonds are formed by heat welding the two ribbons together on either side of the strap. The bonds form seams which are at an angle to the respective sides of the ribbon with adjacent seams being at angles opposite to one another. Therefore, when the strap is pulled the ribbon is drawn into a plurality of loops offset from one another according to the angle of the seams, forming a bow.

The prefabricated bow is formed by a machine having a bench and a press (i.e. similar to a mangle press) with a plurality of heating elements positioned along the bench and press. The heating elements are formed of metal blocks having small heating pads which mate when the press is pivoted down onto the bench providing spot welds at intervals along the length of a pair of ribbons having a strap disposed between them. The pair of ribbons are supplied from ribbon rolls and a roll of strap material which are drawn into the machine through pinch rollers. As each bow is formed and advanced, the tail end of the ribbon and strap is cut off at predetermined lengths. Initially a stapler or some other means attaches the strap and the two ribbons together at the head end.

After the particular length of mated ribbon and strap are drawn into the machine, trimmed and attached, the press is brought down on the bench for a predetermined period of time to produce bonded seams at selected intervals along the two ribbons on either side of the strap. Preferably the press is pneumatically operated and controlled by an interval timer to avoid excess heating of the ribbon. The heating blocks on the bench and press mate and bond the two ribbons at preselected intervals and at angles with the respective sides to the ribbons. Further, the blocks on the bench and press are so positioned to provide these bonded seams at angles with raspect to adjacent bonded seams. The number of seams determines the number of loops and hence the size of the bow. For example, with four equally spaced, oppositely angled seams an eight loop bow will be formed. An ornamental device is secured at the head end of the ribbon where the strap is attached, which will be disposed at the center of the bow when the strap is pulled, drawing the ribbon into a bow.

These and other objects, advantages and features of the invention will be more fully understood from the following detailed description when considered in conjunction with the accompanying drawings in which:

DETAILED DESCRIPTION OF THE INVENTION

Figure 1:
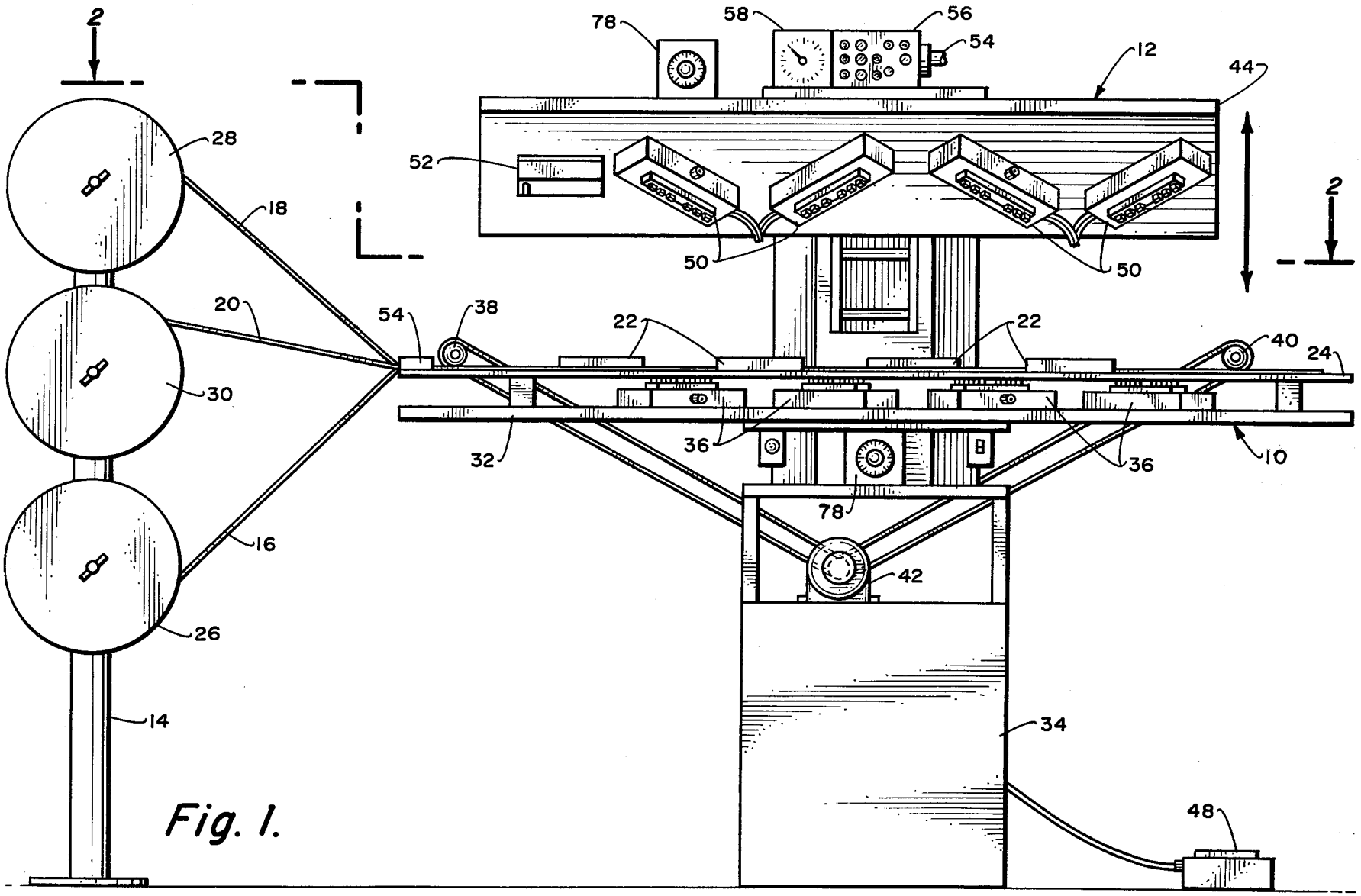
FIG. 1 is a side elevation of a bow forming machine constructed according to the invention.

A bow forming machine for forming prefabricated bows according to the invention is shown generally in FIG. 1. The machine is built on a principle similar to a bench or mangle press. The machine has a lower or bench assembly 10, an upper pivotable assembly or press 12 and a ribbon supply stand 14. Ribbon 16 and 18, along with strap 20, is supplied to a track formed by blocks 22 spaced along a table 24. The ribbon and strap are supplied from spools 26, 28 and 30 mounted on spindles on the ribbon supply stand 14. The ribbon 16 and 18 and strap 20 are first hand fed through the machine by an operator to the end of the table 24. The strap 20 is aligned in the center between the two mated ribbons 16 and 18.

The bow forming machine is designed to form heat welded seams bonding the ribbon material 16 and 18 together around the strap 20. The strap will be disposed lengthwise of the bonded ribbon material and is securely fastened at the head end of the prefabricated bow, between the two ribbons, by stapling. The machine can produce prefabrciated bows of various widths and lengths determined by the number of welded seams and the width of the track formed by blocks 22 to produce various sizes and shapes of bows.

The lower assembly 10 is comprised of a plate 32 mounted on a stand or support 34. The plate 14 supports heating elements 36 spaced along the lower assembly 10 at predetermined intervals, as will be described in greater detail hereinafter. The table 24 is supported on the lower assembly 10 and has guide blocks 22 forming a guide track for the ribbon delivered to the table 24. Ribbon is advanced on the table 24 by being pulled through to the end by an operator, assisted by pinch rollers 38 and 40 driven by motor 42.

The upper assembly 12 is also comprised of a plate 44 supported on a pneumatically operated pivotal arm 46 which is activated by footswitch 28. Each time footswitch 48 is operated, upper assembly 12 swings down, as indicated by the arrow, to mate with the lower assembly 10. The upper assembly 12 also includes heating elements 50 identical with and constructed to mate with the heating elements 36 on the lower assembly 10. An automatic stapler 52 for stapling the ribbon material 16 and 18 together with the strap material 34 may be provided. When the upper assembly or press 12 is pivoted downward against the lower assembly 10, the stapler 26 automatically staples the ribbons and strapping together at the head end. Alternately, the operator can hand staple the head end of the ribbons and strap together as a completed bow comes off the machine.

The ribbon from rolls 26, 28 and strapping material 30 are delivered through a smoothing plate 54 to pinch roller 38 and 40 driven by electric motor 42. The pinch rollers 38 and 40 assist in ejecting a fully formed bow and draw new ribbon and strapping material into the machine each time the upper assembly or press 12 is raised. The operator cuts and trims off the head end of the prefabricated bow at the tail end of the next bow being formed. Although a single track machine is being described, a two track system in which two bows are simultaneously formed may be easily constructed.

The operator forms each bow by activating foot switch 48 causing upper assembly 12 to swing down against lower assembly 10. The upper assembly is pneumatically operated through hose 54 and control 56. The foot switch 48 is connected to the control 56 through timer switch 58 which disconnects the foot switch, opening the press after a preselected interval. Intervals of four to six seconds are preferred.

Figure 2:
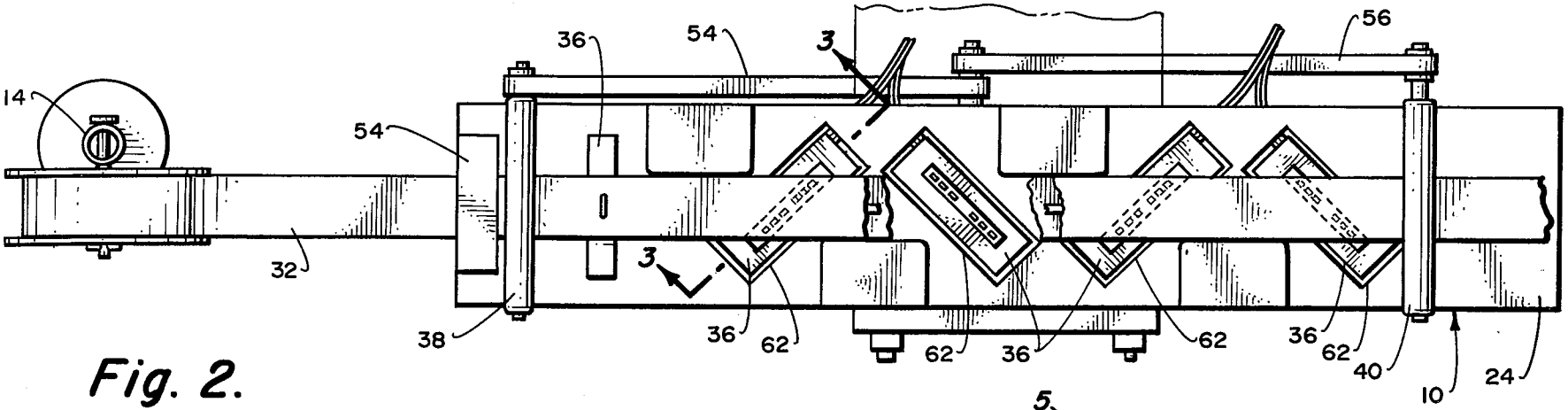
FIG. 2 is a view of the bow forming machine according to the invention taken at 2—2 of FIG. 1.

The single track lower assembly 10 is illustrated in greater detail in FIG. 2. The table 20 has openings 62 for receiving heating elements 36 which project up into the openings to be even or slightly above the level of the table 24. The heating elements 36 on lower assembly 10 thus mate with the heating elements 28 in the upper assembly 12 when the upper assembly comes down. The heating elements are mounted at preselected intervals in the upper and lower assemblies with adjacent heating elements being at opposite angles. In this manner, the heating elements form seams traversing the ribbon on either side of the strap material 20 which are oppositely angled. The oppositely angled seams formed by the heat welds in the ribbon create the bow as will be described hereinafter.

Figure 3:
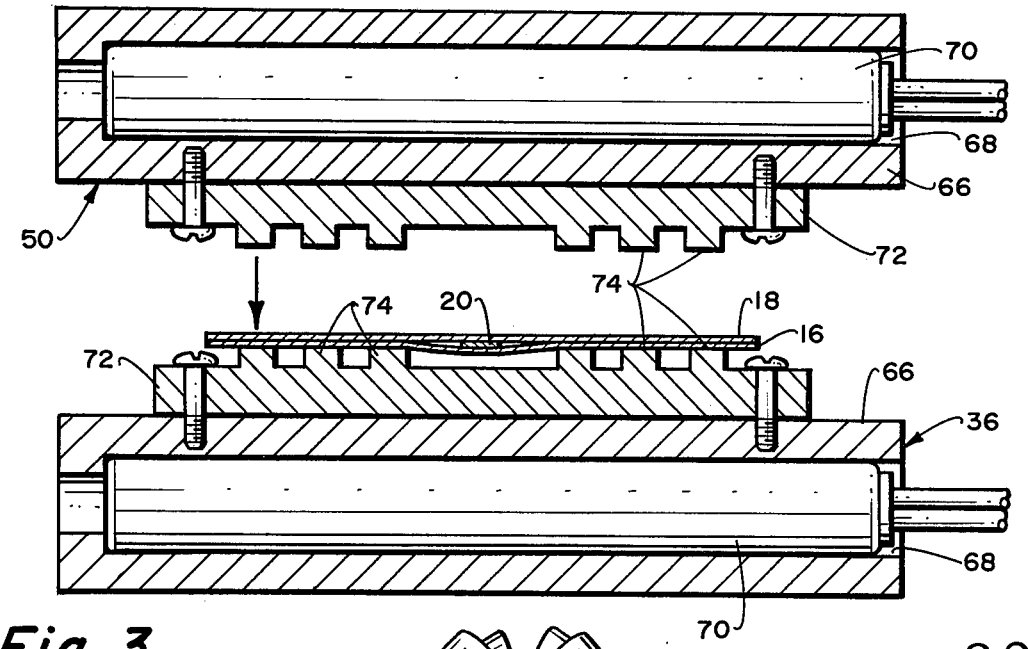
FIG. 3 is a sectional view taken at 3—3 of FIG. 2.

The heating elements are shown in detail in FIG. 3. The heating elements 36 and 50 in the upper and lower assemblies are identical in construction. Each is formed of an identical high heat conducting metal block 66, such as aluminum or steel, having bore 68 for receiving a thermocouple controlled heater 70. Mounted on each block in intimate heat conducting contact is a metal welding element 72 having welding tips or pads 74 which mate and contact the upper and lower ribbons forming a heat weld to bond the two ribbons 16 and 18 together around the strap material 20. The tips 74 have a size and shape designed to contact only an area sufficient to form a good seam 64 (FIG. 4) without heating the ribbons excessively. Too little heat will not form a good bond while excessive heat can burn holes in the ribbon. Thus, seam 64 in the prefabricated bow is formed of three small spot welds on either side of the strap 34. As shown in FIG. 5, the seams 64 are formed of three small rectangular spot welds 76 formed in the ribbon on either side of the strap 20

To provide good, strongly bonded seams formation of the spot welds is controlled by thermocouple controlled heaters 70 set to the temperature dialed into temperature control devices 78 (FIG. 1). The combination of the controlled area to be heat welded, automatic temperature control 78 and the timed cycle provides a securely bonded seam in the ribbon material while preventing damage to the ribbon. Each heating element 36 and 50 contains its own thermocouple controlled heater connected to the temperature control devices 78. The temperature dialed in the temperature control device maintains heat levels to a very close tolerance. The upper and lower assemblies each have a dial controlled accurate thermostat 78. Such dial operated temperature controls or thermostats are readily available from various sources. The blocks and the heating pad 72, as well as the point 74, are machined to specific dimensions and shapes designed for optimum heat transfer with minimal heat loss.

The upper assembly is operated by a pneumatic control 56 energized by foot switch 48. The timer disconnects the switch 48 after a predetermined cycle time to open or lift the upper assembly 12 to prevent overheating and burning of the ribbon. The combination of closely controlled temperature, heated area, and precisely timed operation provides for a strong, securely bonded seam in the ribbon without damage to the ribbon or strap. A cyclic operation in the range of four to six seconds is preferred, permitting approximately ten prefabricated bows to be manufactured per minute for a single track bow forming machine, and twenty prefabricated bows being formed on a double track machine.

The ribbon supply and drive assembly as described earlier is comprised of pinch rollers 38 and 40, connected through a belt or chain drive to motor 42 which assists in advancing the ribbon and strap material a predetermined distance, then shuts off. Suitable microswitches (not shown) control the ribbon feed or drive system operation.

Figure 4:
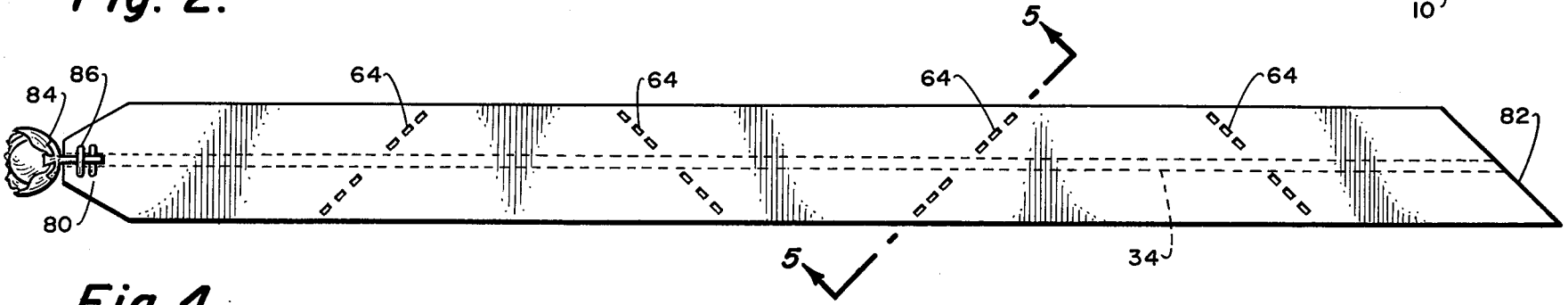
FIG. 4 is a view of a prefabricated bow formed by the machine of FIG. 1.
Figure 5:
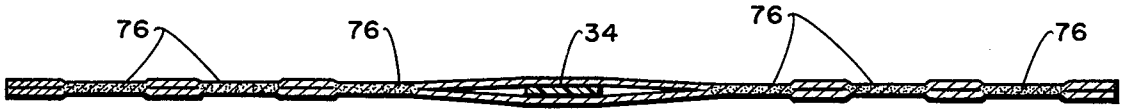
FIG. 5 is a sectional view of a prefabricated bow according to the invention taken at 5—5 of FIG. 4.
Figure 6:
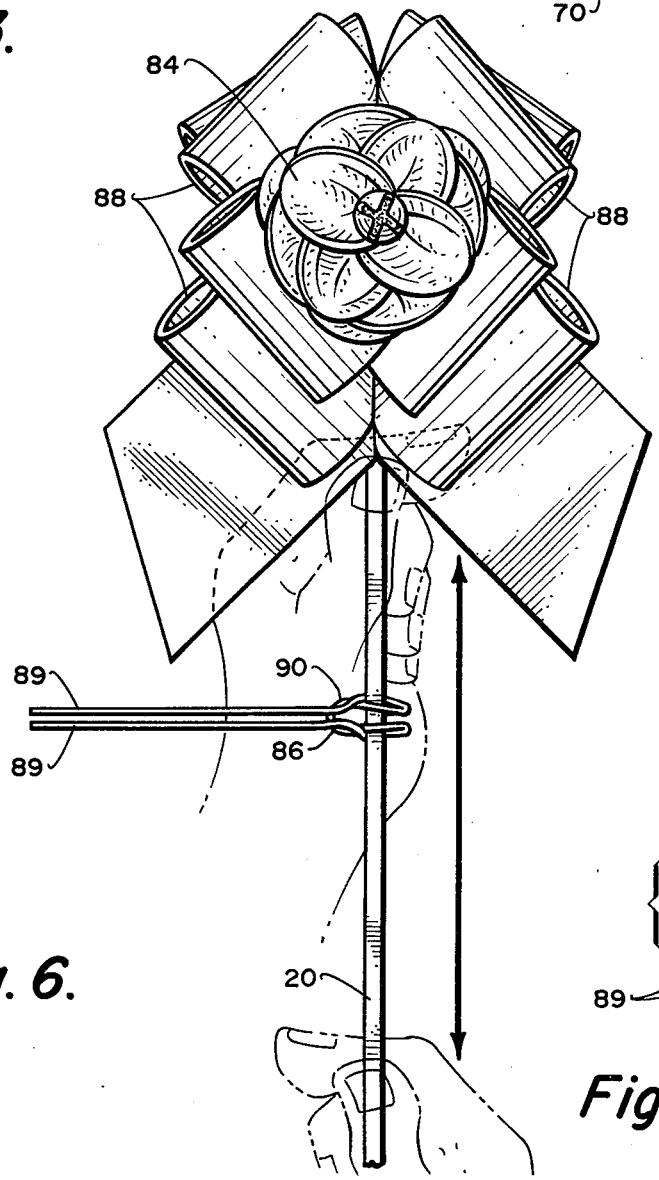
FIG. 6 is a perspective view illustrating the generation of a bow from the prefabricated bow of FIG. 4.
Figure 7A:
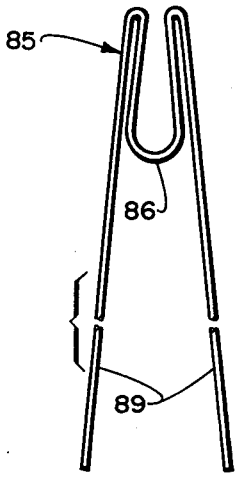
FIGS. 7A-C illustrate a unique locking clip for attaching a completed bow to a plant or floral arrangement.
Figure 7B:
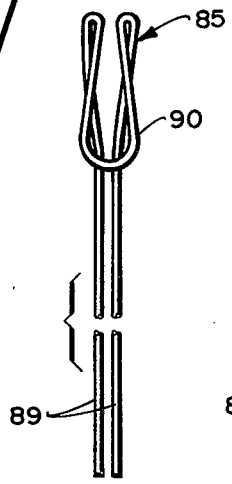
Figure 7C:
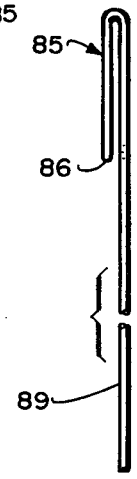

A completed prefabricated bow is illustrated in FIGS. 4 through 6. The prefabricated bow shown has four seams along its length formed of spot welds on either side of strap 34. When a bow is completed, the operator pulls it through the machine and cuts it at the head end 80, forming the angled cut at the tail end 82. The head end is then trimmed as shown and a device such as a flower 84 is secured such as by stapling at 86. A bow is formed by gripping strap 34 with one hand as illustrated in FIG. 6 and pushing upward with the other hand at the bottom seam as indicated by the arrow. When the strap 34 is fully withdrawn and the ribbon fully pushed to the top, each section of ribbon between the seams forms a pair of oppositely directed loops 88 producing a bow having the ornamental device or flower 84 neatly positioned in the center. A prefabricated bow having four seams as shown in FIG. 4, will produce a bow having eight loops with each loop offset about approximately 90° for seams formed at an angle of 45°.

The bow is secured after formation by a clip 85 constructed as illustrated in FIGS. *7a* and *7b*. The clip is comprised of wire formed into a loop 90 which is then bent back to form elongated prongs 88. The prongs 88 are then bent forward again to pass over the sides of the loop 86 as illustrated in FIGS. *7b* and *7c*. To secure the fully formed bow shown in FIG. 6, the clip slips onto the strap 20 as shown at 90 of FIG. 6. The clip will be pushed snugly up against the bottom of the bow and the prongs 88 bent back around the loop 90, securely locking the clip to the strap. The strap 20 may now be cut off close to the bow. The elongate prongs 88 are then available for mounting the bow, for example on a plant, by sticking the prongs in the soil in the pot or floral arrangement. Thus, the clip 85 not only holds the bow in the formed position but also provides means for attaching the bow to a plant, display, etc.

To summarize, the operation and the prefabricated bow form is as follows. Ribbon material 16 and 18 and strap material 20 are pulled through the track on table 24 of the lower assembly of the bow forming machine through pinch rollers 48 and 50 until they reach the end of the table opposite the reels. The operator then activates foot switch 48 which brings down upper assembly 12, stapling the two ribbons together, securely attaching the strap between the ribbons. Heating blocks 36 and 50 mate together at tips 74 (FIG. 3) to melt the ribbons together to form seams 64. After the preset cycle time set in timer 58, the upper assembly 12 is released and the completed bow is pulled through the machine, cut and trimmed by the operator and a flower attached to the head end. The operator then energizes switch 48 and the cycle repeats.

The prefabricated bow then has an ornamental device such as a flower 84 attached and is ready for shipping flat. Alternately, the bow can be formed by grasping the strap 20 and pushing up on the ribbon material at the last seam to form the bow as shown in FIG. 6. The bow is then clamped in place by clip 85 and the strap 20 cut off. The bow is now ready for attachment to a plant or floral arrangement.

Thus, there has been disclosed an automatic prefabricated bow forming machine and a prefabricated bow formed thereby having a unique locking and mounting clip for securing the bow and attaching it to a plant or floral arrangement.

Obviously, the invention is not to be limited to the embodiment shown in the drawing and described in the description which is given by way of example and not of limitation but only in accordance with the scope of the appended claims.

What is claimed is:

1. A machine for forming prefabricated bows comprising:

a lower assembly having means forming a guide track;

a movably mounted upper assembly being movable to and away from a position juxtaposed to said lower assembly;

supply means for supplying preselected lengths of mated ribbon material having a strap centrally disposed therebetween to the track on said lower assembly;

fastening means securely fastening said preselected lengths of ribbon material and said strap together at one end;

a plurality of heating elements on said lower assembly;

a plurality of heating elements on said upper assembly;

said upper assembly heating elements mating with said lower assembly with said preselected length of ribbon and strapping material therebetween when said upper assembly is moved toward said lower assembly;

said heating elements on said upper and lower assemblies being constructed and arranged to bond said ribbons together at preselected intervals by producing a plurality of heat welded seams with adjacent seams being at angles opposite to one another and at approximately 45 degrees.

2. The machine according to claim 1 in which there are at least three heating elements on said upper and lower assemblies.

3. The machine according to claim 2 in which said heating elements on said upper and lower assemblies comprise; heat blocks on said upper and lower assemblies; a plurality of heating tips securely attached to said heat blocks; said heat tips constructed and arranged to mate when said upper assembly is moved in juxtaposition wherein said welded seams are formed as a plurality of spot welds.

4. The machine according to claim 3 in which said heating tips are constructed and arranged to produce a welded seam of three in-line spot welds on either side of said strap.

5. The machine according to claim 3 in which said heating tips produce substantially small rectangular spot welds whereby the area of welds is substantially reduced to near minimum area necessary to produce a good seam.

6. The machine according to claim 1 in which said fastening means for fastening one end of said ribbons with said strap between comprises stapling means; said stapling means constructed and arranged to securely staple the strap and ribbons together when said upper assembly is moved to bring said heating elements into mating relationship.

7. The machine according to claim 1 including means to control the temperature of said heat elements.

8. The machine according to claim 7 in which said means to control the temperature comprise: thermocouple controlled heating elements mounted on said heat blocks; temperature control means responsive to said thermocouples, said temperature control means having means for setting a predetermined temperature for said heating elements.

* * * * *